US007849825B2

(12) United States Patent
Scheidig et al.

(10) Patent No.: US 7,849,825 B2
(45) Date of Patent: Dec. 14, 2010

(54) CONTROL VALVE FOR A DEVICE FOR CHANGING THE CONTROL TIMES OF AN INTERNAL COMBUSTION ENGINE

(75) Inventors: Gerhard Scheidig, Nuremberg (DE); Ali Bayrakdar, Rothenbach/Pegn. (DE); Jens Hoppe, Erlangen (DE); Rainer Ottersbach, Aurachtal (DE)

(73) Assignee: Schaeffler Technologies GmbH & Co. KG, Herzogenaurach (DE)

( * ) Notice: Subject to any disclaimer, the term of this patent is extended or adjusted under 35 U.S.C. 154(b) by 408 days.

(21) Appl. No.: 12/064,135

(22) PCT Filed: Aug. 4, 2006

(86) PCT No.: PCT/EP2006/007710

§ 371 (c)(1),
(2), (4) Date: Feb. 19, 2008

(87) PCT Pub. No.: WO2007/025630

PCT Pub. Date: Mar. 8, 2007

(65) Prior Publication Data

US 2008/0236529 A1 Oct. 2, 2008

(30) Foreign Application Priority Data

Sep. 1, 2005 (DE) ..... 10 2005 041 393

(51) Int. Cl.
*F01L 9/02* (2006.01)

(52) U.S. Cl. ..... 123/90.12; 123/90.13; 123/90.15; 137/625

(58) Field of Classification Search ..... 123/90.12, 123/90.13, 90.15, 90.17; 137/511, 625
See application file for complete search history.

(56) References Cited

U.S. PATENT DOCUMENTS

| | | | | |
|---|---|---|---|---|
| 6,701,877 | B1 * | 3/2004 | Ottersbach et al. | 123/90.17 |
| 7,025,023 | B2 * | 4/2006 | Lehmann et al. | 123/90.17 |
| 7,533,695 | B2 * | 5/2009 | Strauss et al. | 137/625.68 |
| 2004/0226526 | A1 | 11/2004 | Palesch et al. | |

FOREIGN PATENT DOCUMENTS

| | | |
|---|---|---|
| DE | 19809175 | 9/1999 |
| DE | 19944535 | 1/2001 |
| DE | 102004035035 | 3/2005 |
| DE | 10346443 | 5/2005 |
| EP | 1447602 | 8/2004 |
| EP | 1596041 | 11/2005 |

* cited by examiner

*Primary Examiner*—Ching Chang
(74) *Attorney, Agent, or Firm*—Volpe and Koenig, P.C.

(57) ABSTRACT

A control valve (20) for a device for variably setting the control times of gas exchange valves (110, 111) of an internal combustion engine (100). Two working ports (A, B) and one supply port (24) are formed on an outer casing surface of a valve housing (22) of the control valve (20), the working ports (A, B) are arranged directly adjacent one another, and the supply port adjoins them. Further, two pressure medium ducts (40, 41) are formed on the control piston (30), at least one of the pressure medium ducts (40, 41) is embodied so that it is not rotationally symmetric with respect to a longitudinal axis (36) of the control piston (30).

18 Claims, 7 Drawing Sheets

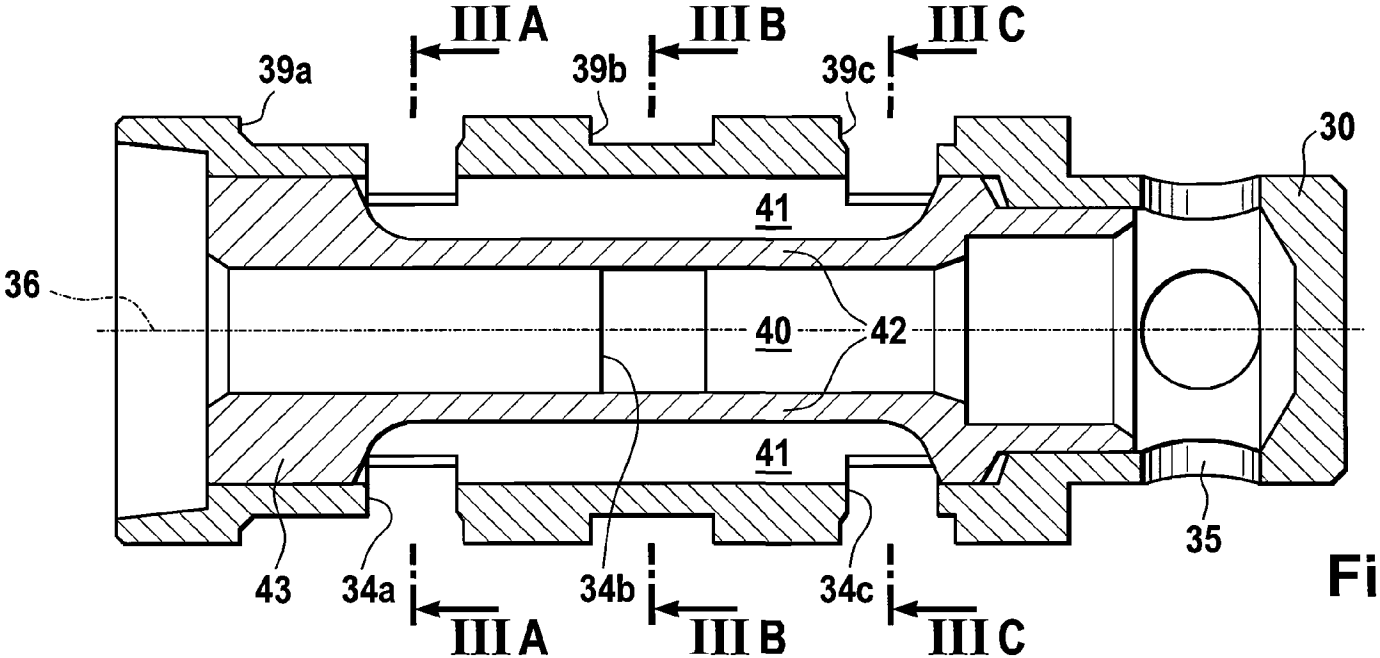
Fig. 3
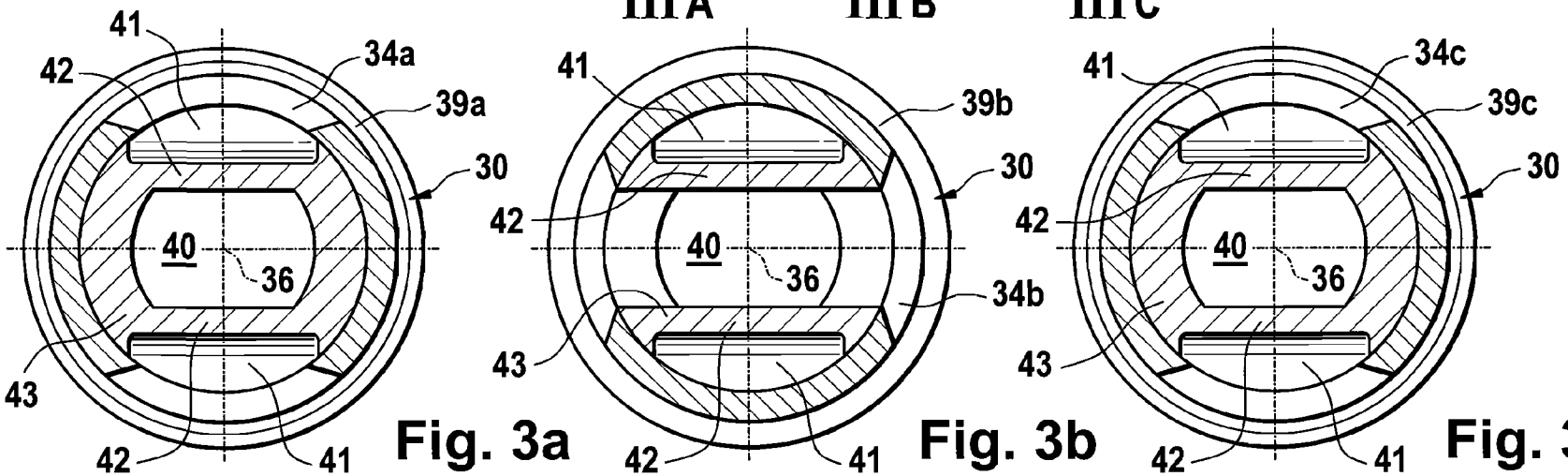
Fig. 3c
Fig. 3b
Fig. 3a

CONTROL VALVE FOR A DEVICE FOR CHANGING THE CONTROL TIMES OF AN INTERNAL COMBUSTION ENGINE

BACKGROUND

The invention relates to a control valve for a device for changing the control times of an internal combustion engine according to the preamble of Claims 1 or 2 and to a device for changing the control times of an internal combustion engine according to the preamble of Claim 18.

In internal combustion engines, camshafts are used for actuating the gas-exchange valves. Camshafts are mounted in the internal combustion engine in such a way that cams located on these camshafts contact cam followers, for example, cup tappets, finger levers, or rocker arms. If a camshaft is set in rotation, then the cams roll on the cam followers, which actuate, in turn, the gas-exchange valves. Through the position and the shape of the cams, both the opening period and also the opening amplitude, as well as the opening and closing times of the gas-exchange valves are set.

Modern motor concepts involve the variable design of the valve train. On one hand, the valve stroke and valve opening period should have a variable form up to complete shutdown of the individual cylinders. For this purpose, concepts, such as switchable cam followers or electrohydraulic or electrical valve actuators are provided. Furthermore, it has been shown to be advantageous during the operation of the internal combustion engine to be able to influence the opening and closing times of the gas-exchange valves. In this way, it is especially desirable to influence the opening or closing times of the intake or exhaust valves separately, in order to selectively set, for example, a defined valve overlap. By setting the opening or closing times of the gas-exchange valves as a function of the current characteristic map range of the motor, for example, as a function of the current rotational speed or the current load, the specific fuel consumption can be lowered, the exhaust-gas behavior can be positively influenced, the motor efficiency, the maximum torque, and the maximum output can be increased.

The described variability of the gas-exchange valve control times is achieved through a relative change in the phase position of the camshaft with respect to the crankshaft. In this way, the camshaft is usually in driven connection with the crankshaft via a chain, belt, or gear train or drive concepts with an identical function. Between the chain, belt, or gear train driven by the crankshaft and the camshaft there is a device for changing the control times of an internal combustion engine, also called camshaft adjuster below, which transfers the torque from the crankshaft to the camshaft. Here, this device is constructed such that during the operation of the internal combustion engine, the phase position between the crankshaft and the camshaft can be held reliably and, if desired, the camshaft can be rotated within a certain angle range with respect to the crankshaft.

In internal combustion engines with a camshaft for the intake and the exhaust valves, these can each be equipped with a camshaft adjuster. Therefore, the opening and closing times of the intake and exhaust gas-exchange valves can be shifted in time relative to each other and the valve overlap can be set selectively.

The position of modern camshaft adjusters is usually located on the drive-side end of the camshaft. The camshaft adjuster can also, however, be arranged on an intermediate shaft, a non-rotating component, or the crankshaft. It is comprised of a drive wheel, which is driven by the crankshaft and which maintains a fixed phase relationship with respect to the crankshaft, a driven part in driving connection with the camshaft, and an adjustment mechanism transferring the torque from the drive wheel to the driven part. The drive wheel can be constructed as a chain, belt, or gear wheel in the case of a camshaft adjuster not arranged on the crankshaft and is driven by the crankshaft by a chain, belt, or gear train. The adjustment mechanism can be operated electrically, hydraulically, or pneumatically.

Two preferred embodiments of hydraulically adjustable camshaft adjusters represent the so-called axial piston adjuster and rotary piston adjuster.

In the axial piston adjusters, the drive wheel connects to a piston and this is connected to the driven part each by helical gears. The piston separates a hollow space formed by the driven part and the drive wheel into two pressure chambers arranged axial with respect to each other. If one pressure chamber is charged with pressure medium, while the other pressure chamber is connected to a tank, then the piston is shifted in the axial direction. The axial shifting of the piston is translated by the helical gears into a relative rotation of the drive wheel with respect to the driven part and thus the camshaft with respect to the crankshaft.

A second embodiment of hydraulic camshaft adjusters are the so-called rotary piston adjusters. In these adjusters, the drive wheel is locked in rotation with a stator. The stator and a rotor or driven element are arranged concentric to each other, wherein the rotor is connected to a camshaft, a projection of the camshaft, or an intermediate shaft with a non-positive, positive, or material fit, for example, via a press fit, screw or weld connection. In the stator there are several hollow spaces, which are spaced apart in the peripheral direction and which extend outward in the radial direction starting from the rotor. The hollow spaces are bounded in a pressure-tight way in the axial direction by a side cover. In each of these hollow spaces, a vane connected to the rotor extends, which divides each hollow space into two pressure chambers. Through selective connection of the individual pressure chambers to a pressure medium pump or to a tank, the phase of the camshaft can be set or held relative to the crankshaft.

For controlling the camshaft adjuster, sensors detect the characteristic data of the engine, such as, for example, the load state and the rotational speed. This data is fed to an electronic control unit, which controls the supply and discharge flows of pressure medium to the different pressure chambers after comparing the data with a characteristic data map of the internal combustion engine.

To adjust the phase position of the camshaft with respect to the crankshaft, in hydraulic camshaft adjusters one of the two counteracting pressure chambers of a hollow space is connected to a pressure medium pump and the other is connected to the tank. The supply of pressure medium with respect to a chamber in connection with the discharge of pressure medium from the other chamber shifts the piston separating the pressure chambers in the axial direction, whereby the camshaft is rotated relative to the crankshaft by means of helical gears in axial piston adjusters. In rotary piston adjusters, the vane is shifted by pressurizing one chamber and decreasing pressure from the other chamber and thus the camshaft is rotated relative to the crankshaft. To maintain the phase position, both pressure chambers are connected either to the pressure medium pump or separated both from the pressure medium pump and also from the tank.

The pressure medium flows to or from the pressure chambers are controlled via control valves, usually by means of a 4/3 directional proportional valve. This has a valve housing, which is provided with a connection for the pressure chambers (working port) and at least two supply ports. At least one of the supply ports is used as a feed port, through which pressure medium is fed from a pressure medium pump to the control valve. In addition, another supply port is used as a discharge port, through which the pressure medium leaving the pressure chambers is guided. Here, it can be provided, for example, that the discharge port communicates with a tank.

Within the essentially hollow, cylindrical valve housing, an axially displaceable control piston is arranged. The control piston can be brought axially into any position between two defined end position by means of an electromagnetic, pneumatic, or hydraulic actuating element, against the spring force of a spring element. The control piston is further provided with control edges, whereby the working ports can be connected to the supply ports and thus the individual pressure chambers or groups of pressure chambers can be connected selectively to the pressure medium pump or the tank. Likewise, a position of the control piston can be set, in which the pressure medium chambers are separated both from the pressure medium pump and also from the pressure medium tank.

Such a control valve is known from U.S. Pat. No. 6,363,896 B1. This is made from an essentially hollow, cylindrical valve housing and a control piston arranged displaceable in this housing in the axial direction. Two working ports, a feed port, and a discharge port are formed on the valve housing. The two working ports and the feed port are constructed as openings spaced axial with respect to each other in the cylindrical casing surface of the valve housing. Here, the feed port lies in the axial direction between the two working ports. In addition, an axial discharge port is provided, by which pressure medium can be discharged from the control valve.

Within the valve housing there is a control piston, which can be shifted by an electromagnetic actuating unit in the axial direction relative to the valve housing. An annular groove is provided, via which either the first or the second working port can be selectively connected to the feed port as a function of the position of the control piston with respect to the valve housing.

The discharge port can be connected either directly to one working port or to the other working port by a pressure medium duct formed within the control piston as a function of the relative position of the control piston within the valve housing.

Furthermore, a supply line is provided, through which the feed port communicates with a pressure medium pump, which feeds pressure medium continuously to the control valve.

The position of the feed port between the working ports requires a complicated pressure medium guide within the driven element. For one, both radial pressure medium lines starting from one of the working ports and also axial supply lines starting from the radial supply port are located within an axial part of the driven element. This accumulation of lines in an axial part decreases their maximum through-flow cross sections.

Another disadvantage comes from the fact that a connection between the axial supply lines and the radial pressure medium lines must be prevented. For this purpose, in the state of the art, the supply lines are constructed by several thin boreholes communicating with each other, by which pressure medium is fed from a camshaft bearing to the feed port. The construction of these boreholes is very expensive and susceptible to errors. In addition, the processing reliability suffers, because thin drills tend to break off when the boreholes are formed.

SUMMARY

Therefore, the invention is based on the objective of preventing these mentioned disadvantages and thus creating a hydraulic control valve, with the pressure medium supply to the feed port and the pressure medium discharge from the tank port being implemented by simple structural features that can be produced economically. Another goal is providing a connection that can be produced easily and economically between the working ports and the pressure chambers of the camshaft adjuster.

In a first embodiment of a control valve for a device for the variable setting of the control times of gas-exchange valves of an internal combustion engine with an essentially hollow, cylindrical valve housing, and a control piston arranged displaceable in this housing in the axial direction, there are exactly two working ports, more precisely, a first and a second supply port, formed on the valve housing. The pressure medium is able to be fed from a pressure medium pump via one of the supply ports to the control valve and pressure medium is dischargeable from the control valve into a tank via the other supply port. Both working ports and the first supply port are formed by at least one radial opening in an outer casing surface of the valve housing, with the working ports and the first supply port being arranged spaced apart from each other in the axial direction, and with the first supply port communicating with a supply line. The objective according to the invention is met in that the working ports are arranged directly adjacent to each other in the axial direction, and the first supply port connecting to the working ports in the axial direction on the side of the supply line.

The control valve according to the invention is made from an essentially hollow, cylindrical valve housing and a control piston arranged displaceable in this housing in the axial direction. The valve housing is arranged within a valve receptacle of a surrounding construction, for example, a camshaft, a cylinder head, or a driven element of a camshaft adjuster, with the outer diameter of the valve housing being adapted to the inner diameter of the valve receptacle. At least three ports spaced apart from each other in the axial direction are constructed in the form of radial openings of the valve housing on the outer casing surface of the valve housing. One radial port is used as a supply port. The remaining radial ports are used as working ports, through which pressure medium can be led to the pressure chambers of the device or can be discharged from these chambers. Here, the supply port can be used as a feed port, via which pressure medium is fed to the control valve, or as a discharge port, via which pressure medium is discharged from the control valve. The supply port is arranged in the axial direction in such a way that between this port and an axial end of the control valve there is no working port.

Through this arrangement of the supply port, a strict separation is produced in the axial direction between the pressure medium lines communicating with the working ports and the supply line, which communicates with the supply port. Thus, not only the pressure medium ports, but also the pressure medium lines starting from these ports are separated from each other in the axial direction, whereby the complexity of the pressure medium system is reduced. The axial supply line no longer penetrates into the region of the radial pressure medium lines, which communicate with the working ports.

Another advantage lies in that the axial pressure medium ducts can be formed with larger cross-sectional surfaces.

Overall, this leads to a considerable simplification of the pressure medium system and thus to a reduction of the production costs of the device.

In an advantageous refinement of the invention, it is provided that the supply line is constructed at least in some sections as an annular space between the valve housing and the surrounding construction. Alternatively, the supply line can be constructed at least in some sections as at least one groove, which is provided on the outer casing surface of the control piston and which opens into the first supply port.

Another simplification of the pressure medium system is given in that the supply line is realized by an intermediate space between the valve housing and the valve receptacle of the surrounding construction. In this way, an annular channel encompassing the valve housing or one or more longitudinal grooves spaced apart from each other in the circumferential direction can be provided, which open into the radial supply port. In the first case of an annular channel, the inner diameter of the valve receptacle has a larger construction than the outer diameter of the valve housing. In the case of the longitudinal grooves, these can be formed on an inner casing surface of the valve receptacle or an outer casing surface of the valve housing. In both cases, this can be performed economically or cost neutral during the shaping process.

Therefore, the boreholes described in the state of the art are superfluous within the rotor, the camshaft, or the cylinder head, which leads to a considerable reduction in costs and an increase in processing security for the production of the device. In addition, the strength or durability problem is solved by bored rotors.

Also conceivable is a combination made from an annular channel and at least one axial channel connecting to this channel. This variant is especially advantageous for embodiments, in which the control valve is used as a central valve. In this case, the region of the valve housing, in which the axial channel is constructed, can be used for centering the device on the camshaft.

Furthermore, it can be provided that at least two axial pressure medium ducts bounded opposite from each other are formed on the control piston, with each of the pressure medium ducts communicating with one of the supply ports in each position of the control piston, with each of the pressure medium ducts being able to be connected to at least one of the working ports through suitable positioning of the control piston relative to the valve housing, and with at least one of the pressure medium ducts having a non-rotationally symmetric construction with respect to the longitudinal axis of the control valve.

Through the construction of two axial pressure medium ducts bounded opposite each other on the control piston, with at least one of the pressure medium ducts having a non-rotationally symmetric construction with respect to the longitudinal axis of the control valve, it can be achieved in a structurally simple and economically producible way that the two working ports directly adjacent to each other in the axial direction can be connected selectively to the radial or the axial supply port. In particular, a port can be produced between the radial supply port and the working port farther apart from this supply port in the axial direction, without the supply port communicating simultaneously with the closer lying working port.

Therefore, structurally complicated measures, such as, for example, additional adapter components or the construction of other supply ports on the valve housing are superfluous, whereby the costs of the device can be farther reduced.

In another embodiment of a control valve for a device for the variable setting of the control times of gas-exchange valves of an internal combustion engine with an essentially hollow cylindrical valve housing and a control piston displaceably arranged in this housing in the axial direction, with two working ports and two supply ports being constructed on the valve housing, with each working port being constructed by at least one radial opening in an outer casing surface of the valve housing, the working ports are spaced apart from each other in the axial direction, and at least two axial pressure medium ducts bounded opposite each other are formed on the control piston, with each of the pressure medium ducts communicating with one of the supply ports in each position of the control piston. Each of the pressure medium ducts is able to be connected to at least one of the working ports through suitable positioning of the control piston relative to the valve housing and, the objective of the invention is met in that at least one of the pressure medium ducts has a non-rotationally symmetric construction with respect to the longitudinal axis of the control valve.

Through the non-rotationally symmetric construction of at least one pressure medium duct with respect to the longitudinal axis of the control valve, the control piston can be used for different valve housing constructions. Here, for example, an insert can be provided in a control valve, with the working ports being arranged directly adjacent to its valve housing. Also conceivable is an insert in a control valve, between whose radial working ports there is a supply port. Thus, one and the same component can be used for control valves with different constructions, which leads to considerable savings in the production of the device.

In addition, the shape of the outer components, primarily in the case of directly adjacent working ports, can be significantly simplified and thus installation space and costs can be saved.

In one refinement of the invention, it is provided that the working ports are arranged directly adjacent to each other in the axial direction.

On the valve housing, exactly two working ports and/or exactly two supply ports can be formed.

Furthermore, it can be provided that one of the supply ports is constructed as a feed port, via which pressure medium is fed to the control valve and/or that one of the supply ports is constructed as a discharge port, via which pressure medium can be discharged from the control valve to a tank.

Through the working ports arranged directly adjacent in the axial direction, the axial installation space requirements of the control valve can be reduced. In addition, a simpler pressure medium feed or discharge is possible to the axially outer supply port. The non-rotationally symmetric construction according to the invention for at least one pressure medium duct with respect to the longitudinal axis of the control valve opens up the advantage of producing the communication between the working port farther removed from the radial supply port to the supply port, without creating a connection with the working port lying in-between. In this way, this can take place without further structural features, such as adapters, with the formation of additional supply ports on the valve housing being able to be eliminated.

In both embodiments it can be provided that at least one pressure medium duct is constructed on an outer casing surface of the control piston.

In this embodiment of the invention, one of the pressure medium ducts is constructed in the interior of the control piston and a groove running in the axial direction is provided on the outer casing surface of the control piston as a second pressure medium duct. From the axial groove extends one or two grooves, which are spaced apart from each other in the axial direction and which extend in the circumferential direction and which produce the connection between the second pressure medium duct and the radial openings spaced apart in the circumferential direction to the pressure medium duct in the valve housing, which form the working ports.

In the case of a groove extending in the circumferential direction, two radial openings, through which the exterior of the control piston can communicate with its interior, are provided on the control piston. In this way, the groove extending in the circumferential direction lies on the outer casing surface of the control piston in the axial direction between the openings and between the working ports, while the openings enclose the working ports in the axial direction. As a function of the position of the control piston relative to the valve housing, the groove extending in the circumferential direction communicates either with the first or the second working port. Simultaneously, one of the two openings of the control piston communicates with the other working port.

In the case of two grooves extending in the circumferential direction, a radial opening is provided on the control piston. This lies in the axial direction between the two channels extending in the circumferential direction and between the working ports, with the grooves extending in the circumferential direction encompassing the working ports. As a function of the position of the control piston relative to the valve housing, one of the two grooves extending in the circumferential direction communicate with the corresponding working port, while the connection of the other groove to the other working port is interrupted. Simultaneously, the opening of the control piston communicates with the other working port.

In both cases, the control elements can be arranged on the control piston in such a way that a middle position exists, in which either both working ports communicate with only the feed port or with none of the supply ports. In this position of the control piston, the phase position of the device is maintained.

Alternatively, it can be provided that all pressure medium ducts are formed within the control piston. In this way, a wall separating the pressure medium ducts from each other is formed in one part with the control piston. It is also conceivable to form the control piston as an essentially hollow cylindrical component, in whose interior a separately constructed insert component is provided, with the insert component forming the pressure medium ducts in interaction with an inner casing surface of the control piston.

In this embodiment, within the control piston there are at least two pressure medium ducts, which are separated from each other and which communicate via radial openings with the exterior of the control piston and thus can be connected to the working ports. The advantage of this embodiment lies in that the valve housing can have a rotationally symmetric construction and the pressure medium supply or discharge is implemented exclusively via the interior of the control piston. Therefore, the pressure medium system is significantly simplified and installation space and costs are reduced.

Advantageously, each of the pressure medium ducts can be connected to each of the working ports through suitable positioning of the control piston relative to the valve housing.

Through these measures it is achieved that exactly two supply ports, namely a feed port and a discharge port, are necessary for operating the device.

In an advantageous refinement of the invention, it can be provided that the control piston is made from a plastic and produced by an injection molding method.

For the injection molding process, molds are produced, which already have all of the typical geometric features of the final component. The production of the component is realized by filling the plastifying plastic into the mold and then curing the material. Here, the shaping of undercuts or hollow spaces is realized by pushing and/or core pulling technology, with the spaces not to be filled with material being filled with one or more molding bodies during the injection molding process. These molding bodies are elements of the injection molding tool and can be removed from the workpiece and reused after the end of the injection molding process. In principle, the use of disposable cores is also conceivable.

Also conceivable is that the control piston is made from a metal and is produced by a metallurgical injection molding method, also known as metal injection molding (MIM). This method runs analogous to the plastic injection molding method described above, with, in this case, the material to be introduced into the mold being made from a mixture of fine metal powder and organic binders. Here, the volume percentage of metal powder is usually greater than 50%. After the injection molding process, the organic binder and possible disposable cores are removed in a subsequent unbinding process. This can be performed either through thermal disassociation and subsequent evaporation or also through solvent extraction. The remaining porous molding bodies are compacted through sintering under various protective gases or under vacuum to form the components with the final geometric properties.

The advantage of this production method is provided in that also structures that are not rotationally symmetric with respect to the longitudinal axis of the control piston can have an economical and functionally reliable production.

In one device for the variable setting of the control times of gas-exchange valves of an internal combustion engine with a control valve, which is arranged in a valve receptacle of a surrounding construction, with an essentially hollow, cylindrical valve housing, and a control piston arranged displaceable in this housing in the axial direction, at least two working ports and at least one first supply port are formed on the valve housing, with pressure medium either being fed from a pressure medium pump to the control valve or being discharged from the control valve into a tank via the supply port, and the first supply port is formed by at least one radial opening in an outer casing surface of the valve housing and is arranged in the axial direction between the working ports on one side and a supply line on the other side, with which this communicates. According to the invention, the supply line is constructed at least in some sections by a groove, which is formed on the inner casing surface of the valve receptacle of the surrounding construction and which opens into the first supply port.

The device for the variable setting of the control times of gas-exchange valves of an internal combustion engine includes at least two pressure chambers acting against each other, through which the phase position between a camshaft and a crankshaft can be selectively adjusted or maintained. For this purpose, pressure medium is fed to the pressure chambers or discharged from these chambers. For controlling the pressure medium flows, a control valve is provided, on which at least two working ports and at least two supply ports are constructed in the form of a feed port and a discharge port. At least one of the supply ports is constructed as at least one radial opening on an outer casing surface of the valve housing, with this contacting the radial working port in the axial direction of the control valve. This supply port communicates with a supply line, which is constructed at least in some sections as an axial groove formed on the valve receptacle of the surrounding construction. Here, the surrounding construction can be, for example, a rotor of a camshaft adjuster, a camshaft, a cylinder head cover, or a cylinder head.

The groove can be formed in a cost-neutral way during the production of the surrounding construction. For example, this can be realized in a cost-neutral way through simple modification of the shaping tool for the production of a rotor made from sintered steel.

Advantageously, the working ports can also be constructed as radial openings spaced apart in the axial direction in the valve housing, with these connecting to the supply ports on the side of the supply ports facing away from the groove in the axial direction. In addition, an axial supply port can be provided, with at least two pressure medium ducts being constructed on the control piston, with each of the pressure medium ducts being connected to one of the supply ports. Advantageously, at least one of the pressure medium ducts has a non-rotationally symmetric construction with respect to the longitudinal axis of the control valve. In this way, it can be provided that all of the pressure medium ducts are constructed within the control piston. In this way, the wall separating the pressure medium ducts from each other can be formed in one piece with the control piston. Alternatively, the control piston can be constructed as an essentially hollow, cylindrical component, in whose interior a separately constructed insert component is provided, with the insert component forming the pressure medium ducts in interaction with an inner casing surface of the control piston.

BRIEF DESCRIPTION OF THE DRAWINGS

Additional features of the invention emerge from the following description and from the drawings, in which embodiments of the invention are shown simplified. Shown are.

DETAILED DESCRIPTION OF THE PREFERRED EMBODIMENTS

Figure 1:
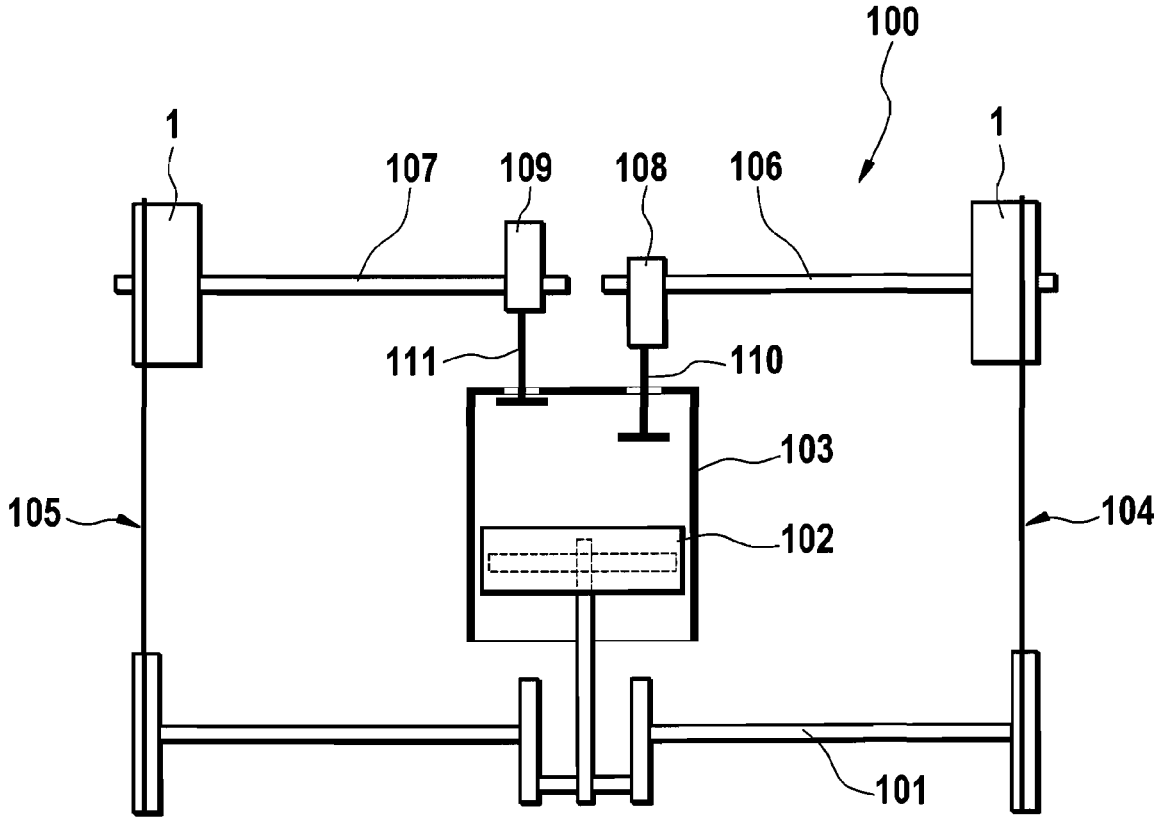
FIG. 1 a very schematically illustrated view of an internal combustion engine, FIG. 2*a* a longitudinal section view through a device for changing the control times of an internal combustion engine with a control valve according to the invention, FIG. 2*b* a cross sectional view through the device from FIG. 2*a,* without a control valve, taken along the line IIB-IIB, FIG. 2*c* a longitudinal section view through a control valve according to the invention, FIG. 3 a longitudinal section view through a first embodiment of a control piston of a control valve according to the invention, FIG. 3*a* a cross sectional view through the control piston shown in FIG. 3 taken along the line IIIA-IIIA, FIG. 3*b* a cross sectional view through the control piston shown in FIG. 3 taken along the line IIIB-IIIB, FIG. 3*c* a cross sectional view through the control piston shown in FIG. 3 along the line IIIC-IIIC, FIG. 4 a longitudinal section view through a second embodiment of a control piston of a control valve according to the invention, FIG. 4*a* a cross sectional view through the control piston shown in FIG. 4 taken along the line IVA-IVA, FIG. 4*b* a cross sectional view through the control piston shown in FIG. 4 taken along the line IVB-IVB, FIG. 4*c* a cross sectional view through the control piston shown in FIG. 4 taken along the line IVC-IVC, FIG. 4*d* a cross sectional view through the control piston shown in FIG. 4 taken along the line IVD-IVD, FIG. 5 a longitudinal section view through a third embodiment of a control piston of a control valve according to the invention, FIG. 5*a* a cross sectional view through the control piston shown in FIG. 5 taken along the line VA-VA, FIG. 5*b* a cross sectional view through the control piston shown in FIG. 5 taken along the line VB-VB, FIG. 5*c* a cross sectional view through the control piston shown in FIG. 5 taken along the line VC-VC, FIG. 5*d* a cross sectional view through the control piston shown in FIG. 5 taken along the line VD-VD.

In FIG. 1, an internal combustion engine 100 is sketched, with a piston 102 sitting on a crankshaft 101 being shown in a cylinder 103. The crankshaft 101 connects, in the shown embodiment, by a traction drive element 104 or 105 to an intake camshaft 106 or an exhaust camshaft 107, with a first and a second device 1 providing for a relative rotation between the crankshaft 101 and the camshafts 106, 107. Cams 108, 109 of the camshafts 106, 107 actuate an intake gas-exchange valve 110 or an exhaust gas-exchange valve 111. Likewise, it can be provided to equip only one of the camshafts 106, 107 with a device 1 or to provide only one camshaft 106, 107, having a device 1.

Figure 2A:
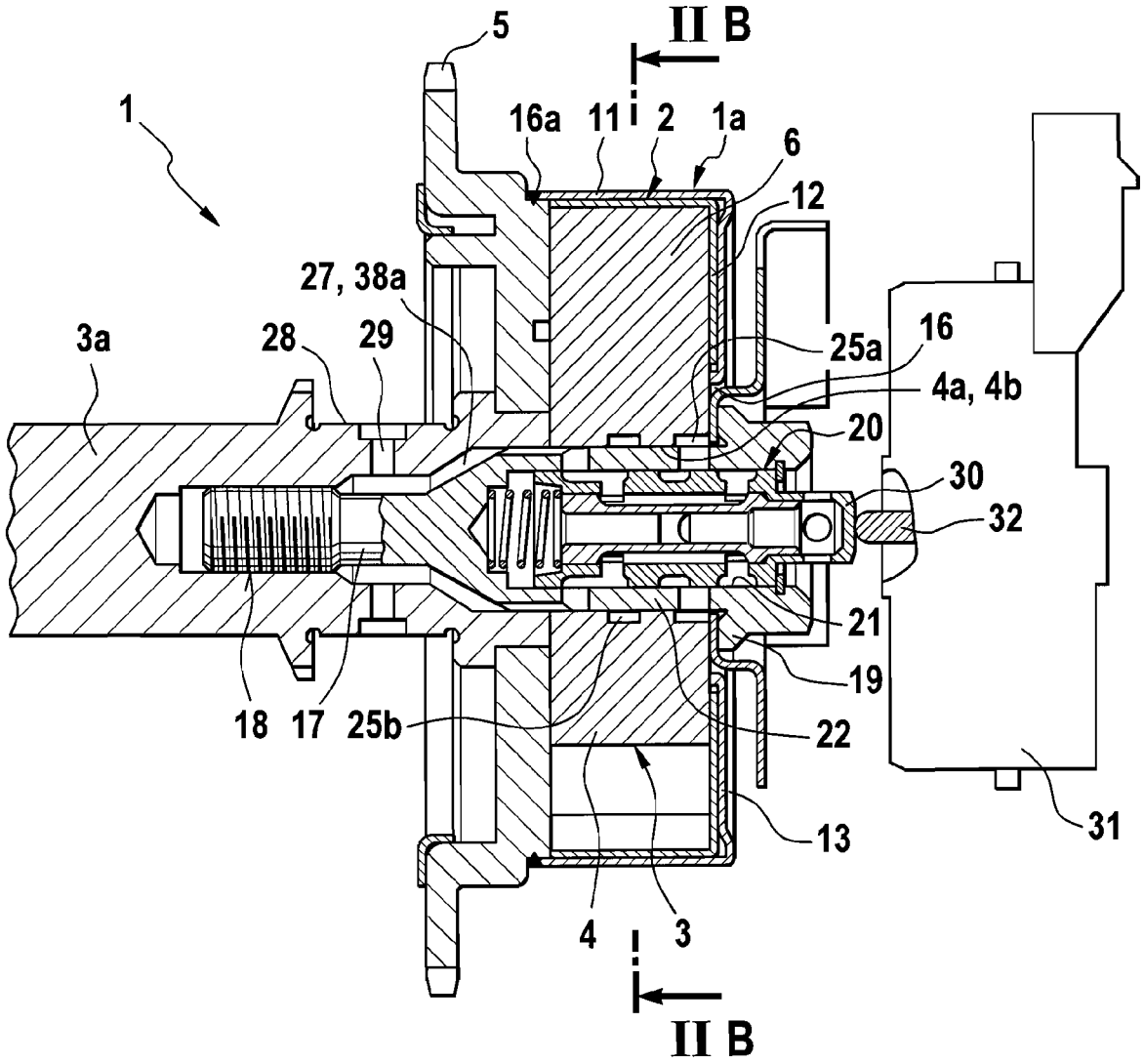
Figure 2B:
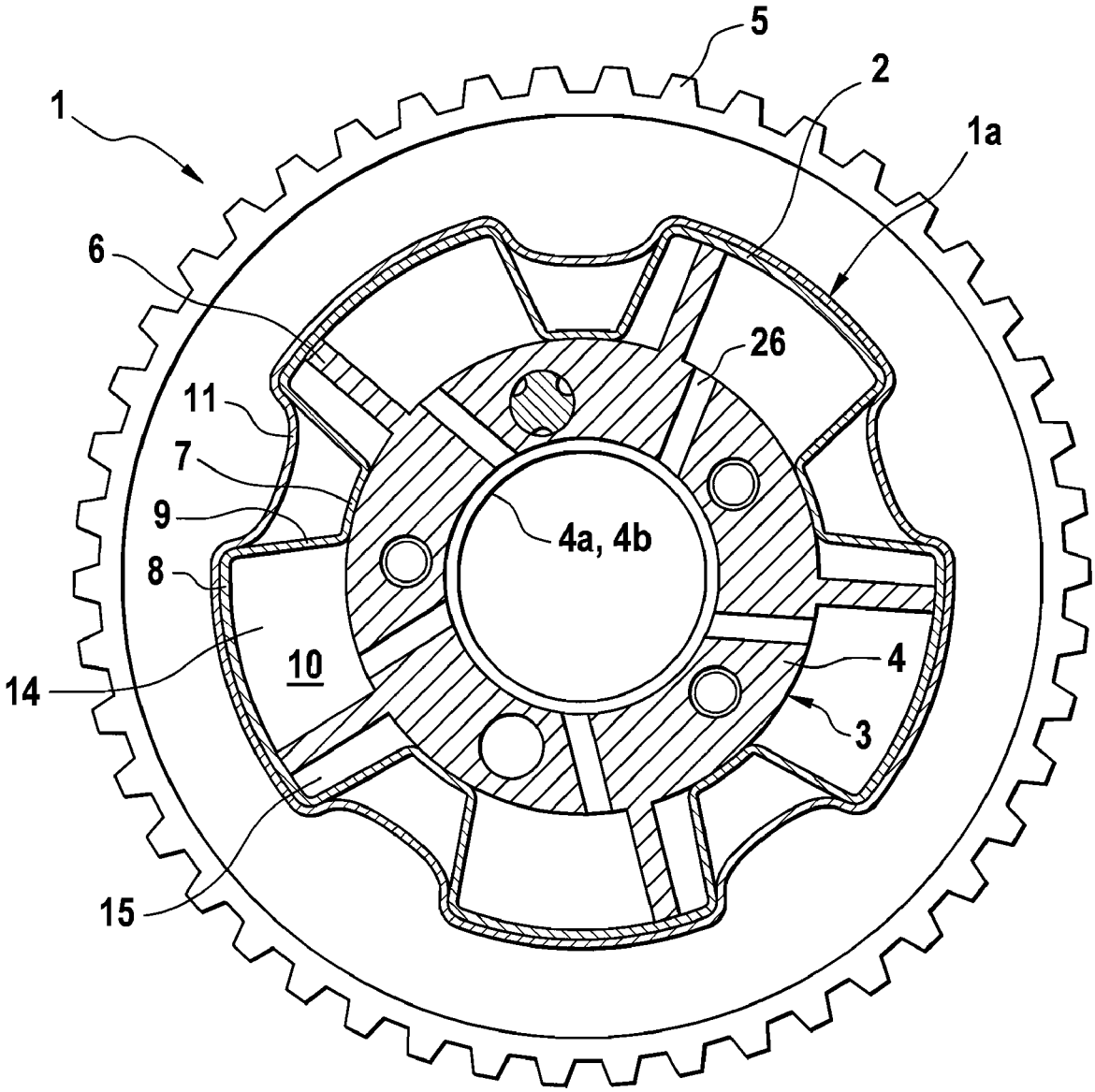
Figure 2C:
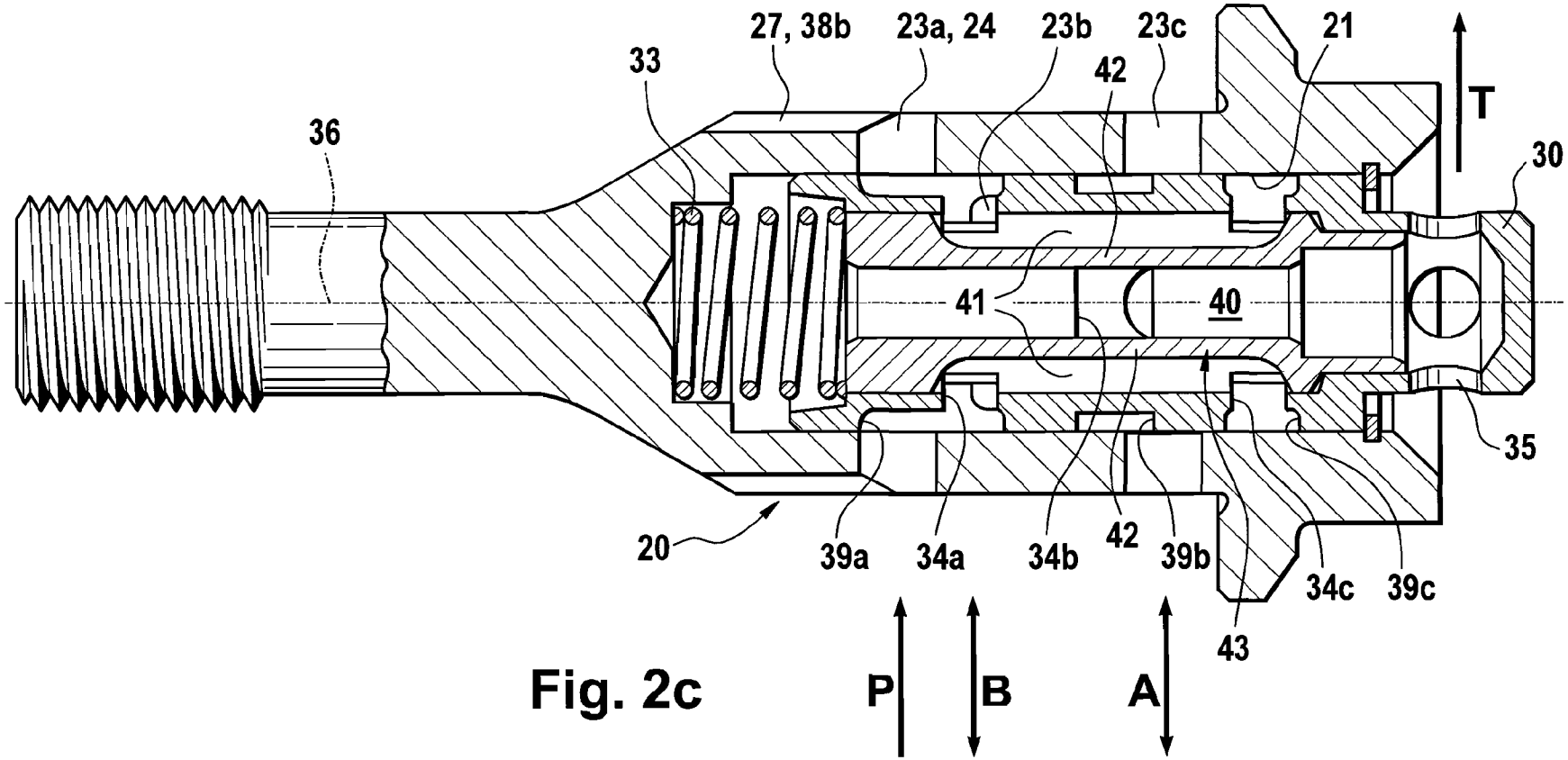
Figures 4, 4A, 4B, 4C, 4D:
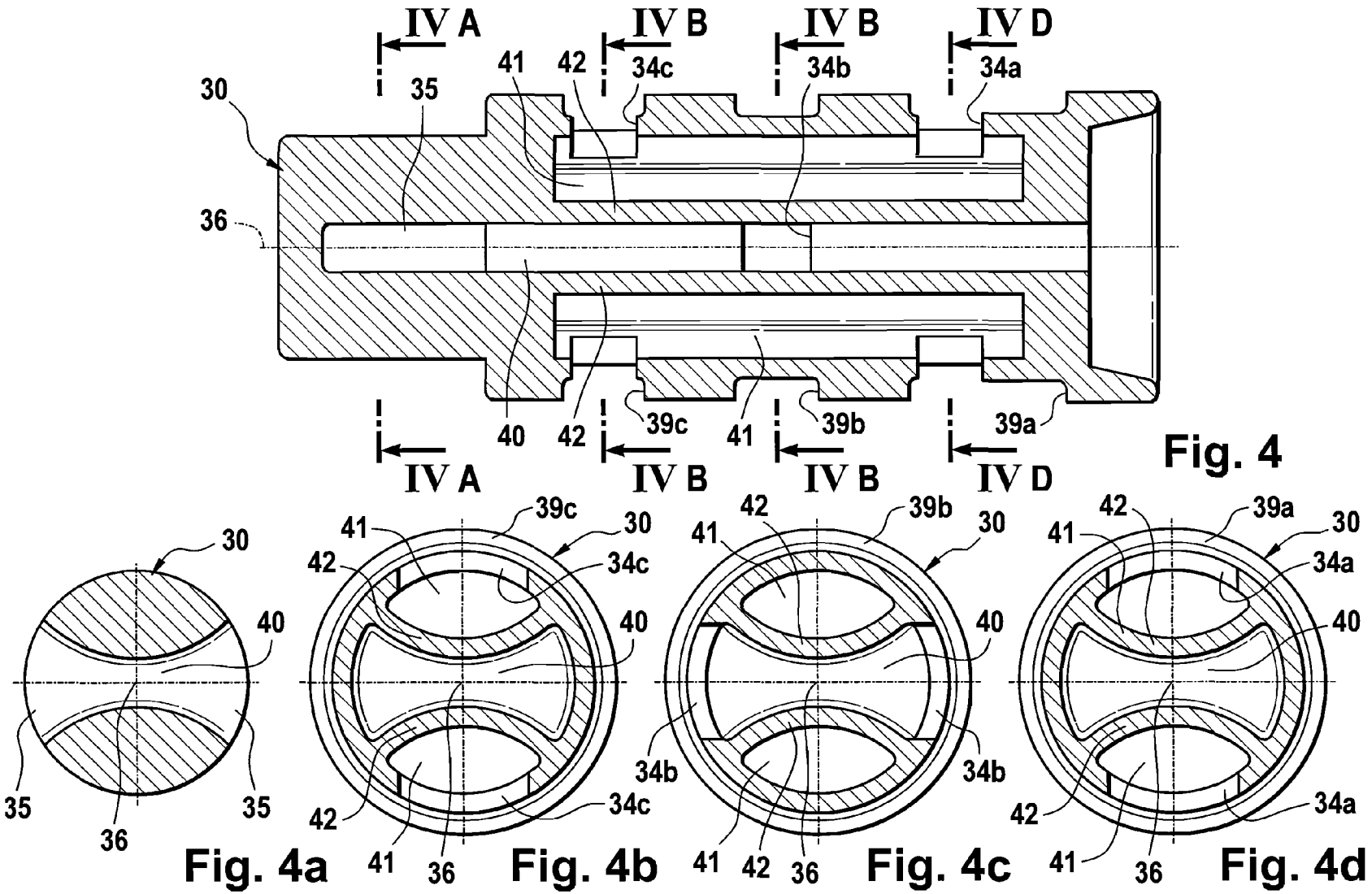
Figures 5, 5A, 5B, 5C, 5D:
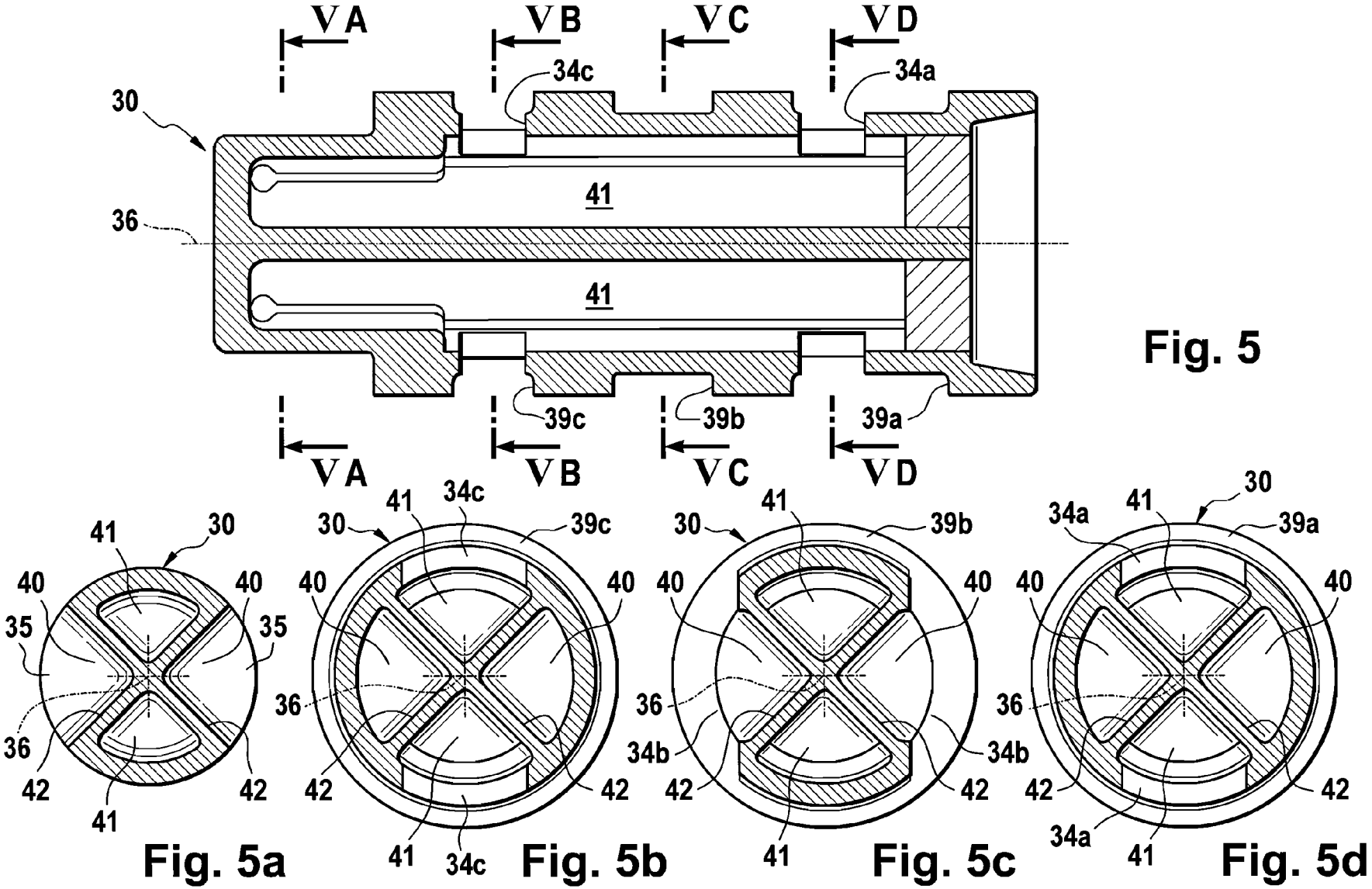

FIGS. 2*a,* 2*b* show a first embodiment of a device 1 for the variable setting of the control times of gas-exchange valves 110, 111 of an internal combustion engine 100.

An adjustment device 1*a* is made essentially from a drive wheel 5, a stator 2, and a rotor, called driven element 3 below, arranged concentric to this stator. The driven element 3 is made from a wheel hub 4, on whose outer circumference five vanes 6 are formed extending outward in the radial direction. Furthermore, the adjustment device 1*a* is provided with a stepped central borehole 4*b,* in which, in the mounted state of the device 1, a camshaft 3*a* engages, in the representation of FIG. 2*a,* from the left. In the mounted state of the device 1, this can be locked in rotation with the camshaft 3*a,* for example, by a non-positive fit, friction fit, positive fit, or material fit connection or by an attachment means. In the shown embodiment, the device 1 is locked in rotation with the camshaft 3*a* by a central screw 17.

The stator 2 is constructed as a thin-walled sheet metal part, with this being comprised of inner circumferential walls 7 and outer circumferential walls 8, which are connected to each other by side walls 9. The inner and the outer circumferential walls 7, 8 extend essentially in the circumferential direction. Using the inner circumferential walls 7, which contact a cylindrical circumferential wall of the driven element 3, the stator 2 is supported so that it can rotate on the driven element 3. Starting from the inner circumferential walls 7, the side walls 9 extend essentially outward in the radial direction and merge into the outer circumferential walls 8. Through this construction, several pressure spaces 10, in the illustrated embodiment five, are formed, which are closed pressure-tight in the axial direction by the drive wheel 5 and a sealing disk 12.

The vanes 6 are arranged on the outer casing surface of the driven element 3 in such a way that exactly one vane 6 extends into each pressure space 10. In this way, the vanes 6 contact the outer circumferential walls 8 of the stator 2 in the radial direction. The width of the vanes 6 is constructed in such a way that these contact the drive wheel 5 and the sealing disk 12 in the axial direction. Therefore, each vane 6 divides a pressure space 10 into two pressure chambers 14, 15 acting against each other.

The stator 2 and the driven element 3 are arranged within a pot-shaped housing 11, which encapsulates these components in a pressure medium-tight way through the interaction with the drive wheel 5. For this purpose, the open end of the housing 11 is connected in an oil-tight way with the drive wheel 5. The connection between the drive wheel 5 and the housing 11 can be realized by a sealing joining method or through the use of a not-shown sealing means. In the shown embodiment, a weld connection 16*a* running in the circumferential direction is provided.

On a base 13 of the housing 11 there is an opening 16 arranged concentric to the central borehole 4*b*. A central screw 17 penetrates the opening 16 and the central borehole 4*b*, with a part of the central screw 17 provided with a thread engaging in a receptacle 18 of the camshaft 3*a* that is provided with an internal thread. The central screw 17 is further provided with a collar 19, which is supported either directly or indirectly on the driven element 3 in the mounted state of the central screw 17 and is thus locked in rotation with the camshaft 3*a*.

The region of the central screw 17, which is arranged within the driven element 3, is constructed as a control valve 20. This region of the central screw 17 extends within the central borehole 4*b*, which acts as a valve receptacle 4*a*. The central screw 17 is provided with a blind hole-like receptacle 21, which extends up to the axial end of the central screw 17 facing away from the camshaft. The resulting cylindrical casing-shaped outer surface of the control valve 20 fulfills the function of a valve housing 22. In this way, the outer diameter of the valve housing 22 is adapted to the inner diameter of the driven element 3.

Furthermore, the valve housing 22 is provided with three groups of openings 23*a, b, c* spaced apart from each other in the axial direction, by means of which the exterior of the valve housing 22 can communicate with the receptacle 21. Each group of openings 23*a, b, c* forms a pressure medium port of the control valve 20, with the camshaft-side group of openings 23*a* forming a supply port 24 and the two other groups of openings 23*b, c* being used as working ports A, B.

On an inner casing surface of the central borehole 4*b* there are two annular channels 25*a*, 25*b* spaced apart from each other in the axial direction in the form of annular grooves, which are open toward the inside in the radial direction and which are bounded by the valve housing 22 toward the inside in the radial direction. Each of the annular channels 25*a*, 25*b* communicates with one of the working ports A, B. Within the driven element 3 there are two groups of pressure medium lines 26, with each of the pressure medium lines 26 communicating, on one side, to one of the pressure chambers 14, 15 and, on the other side, each to one of the annular channels 25*a*, 25*b*.

The supply port 24 of the valve housing 22 is formed in the shown embodiment as a feed port P, through which pressure medium is fed from a pressure medium pump to the control valve 20. This is in fluid connection with a supply line 27 formed between the central screw 17 and the camshaft 3*a*. The supply line 27 communicates with a similarly not-shown pressure medium pump via branch bores 29 formed in the region of a camshaft bearing position 28 and via a not-shown rotary feed through.

Within the receptacle 21 there is an essentially hollow cylindrical control piston 30 held displaceable in the axial direction. In this way, its outer diameter is adapted to the inner diameter of the receptacle 21 of the valve housing 22. The control piston 30 can be positioned arbitrarily by an adjustment unit 31 using a tappet rod 32 against the force of a spring element 33 in the axial direction within the valve housing 22. On the outer casing surface of the control piston 30 there are three annular grooves 39*a*, 39*b*, 39*c* spaced apart from each other in the axial direction, with first radial openings 34*a* being formed within the first annular groove 39*a*, second radial openings 34*b* within the second annular groove 39*b*, and third radial openings 34*c* within the third annular groove 39*c*. Via the radial openings 34*a*, 34*b*, 34*c*, the corresponding annular grooves 39*a*, 39*b*, 39*c* communicate with the interior of the control piston 30. In addition, fourth radial openings 35 are formed on the end of the control piston 30 facing away from the camshaft. These form a second supply port 24, in the shown embodiment a discharge port T, by which pressure medium can be discharged from the control valve 20.

Using the branch bores 29 and the supply line 27, pressure medium can be fed to the feed port P, which can be guided to one of the two working ports A, B as a function of the position of the control piston 30 relative to the valve housing 22. The pressure medium is led via the working port A, B to the corresponding annular channel 25*a*, 25*b* and the corresponding pressure medium line 26 to each pressure chamber 14, 15. Through the supply of pressure medium to one of pressure chambers 14, 15 this expands at the expense of the other pressure chambers 14, 15, with the pressure medium leading from the other pressure chamber 14, 15 via the corresponding pressure medium line 26, the corresponding annular channel 25*a*, 25*b*, and the working port A, B into the interior of the control valve 20. Within the control piston 30, the pressure medium is led from the discharge port T and from there into the crankcase.

The arrangement of the pressure medium ports in the sequence feed port P, working port A, B, working port A, B in the axial direction opens up the possibility of considerably simplifying the structural construction of the pressure medium supply to the supply port P. Instead of realizing the supply line 27, as proposed in the state of the art, by boreholes within the camshaft 3*a* and the driven element 3, in this case, the pressure medium can be fed to the feed port P at the boundary surface between the valve housing 22 and a surrounding construction.

In the shown embodiment, the outer diameter of the central screw 17 is constructed in the region between the branch bores 29 and the drive wheel 5 smaller than the outer diameter of the receptacle 18, which produces an annular space 38*a*. In the connecting region, at least one axial groove 38*b* is provided, which connects the annular space 38*a* to the supply port P. The groove 38*b* can be constructed either on an inner wall of the surrounding construction, in the shown case the camshaft 3*a* and the driven element 3, or the outer casing surface of the valve housing 22.

In each case, these can be constructed during the production process of each component in a cost-neutral way or with only slight extra expense. In comparison with the borehole described in the state of the art, this represents a considerable simplification, while simultaneously increasing the processing reliability and therefore reducing the rejection quota. Overall, this leads to a considerable cost reduction for the production of the device 1.

Here, the use of such a control valve 20 is not limited to the shown embodiment. It is also conceivable to lock the driven element 3 in rotation with the camshaft 3*a* not with a central screw 17, but instead with other friction-fit, non-positive fit, force-fit, or positive-fit means, with a control valve 20 being arranged within a central borehole 4*b* of the driven element 3.

Likewise, the control valve 20 according to the invention can also be constructed as a so-called insert or cartridge valve, which is arranged in a valve receptacle 4*a* formed on a cylinder head or a cylinder head cover.

In the case of central valve applications, the control valve 20 can be arranged, according to the construction of the device 1, for example, within the driven element 3, the camshaft 3*a*, or an elongation of the camshaft 3*a*.

The feed P and the discharge port T can be arranged on the end turned toward or away from the camshaft or on different ends of the control valve 20. In this way, the radial supply port 24 can be used both as a feed port P and also a discharge port T.

Below, the construction and function of the control valve 20 according to the invention will be discussed in more detail.

A first embodiment of a control valve 20 according to the invention is shown in FIGS. 2*c*, 3, 3*a-c*. The outer diameter of the outer casing surface of the essentially hollow cylindrical control piston 30 is adapted to the inner diameter of the valve housing 22. In addition, three annular grooves 39*a, b, c* are constructed on the outer casing surface of the control piston 30, with these being arranged spaced apart from each other in the axial direction.

In the interior of the control piston 30 there is a first, central pressure medium duct 40, on which two second pressure medium ducts 41 contact, which lie on the outside in the radial direction and which extend in the cross section of the control piston 30 only within an angular segment less than 360°.

The pressure medium ducts 40, 41 are separated from each other within the control piston 30 by walls 42, with the two second pressure medium ducts 41 being arranged opposite each other with respect to the longitudinal axis 36 of the control piston 30. The second pressure medium ducts 41 communicate via the first or the third radial openings 34*a*, 34*c* with the first or third annular groove 39*a*, 39*c*. The first pressure medium duct 40 communicates via the second radial openings 34*b* with the second annular groove 39*b*. In this way, the second radial openings 34*b* are offset by 90° relative to the first and the third radial openings 34*a*, 34*c* in the circumferential direction, whereby it is achieved that the first pressure medium duct 40 communicates exclusively with the second annular groove 39*b* and the second pressure medium ducts 41 communicate exclusively with the first and third annular groove 39*a*, 39*c*.

The first annular groove 39*a* is constructed in such a way that this communicates with the feed port P in each position of the control piston 30 relative to the valve housing 22. Through the feed port P, pressure medium entering into the control valve 20 is led into the first annular groove 39*a* and via the second pressure medium ducts 41 to the third annular groove 39*c*. In this way, it is guided past the second annular groove 39*b* within the control piston 30, wherein it is blocked by the walls 42 at the passage through the second radial opening 34*b* and thus from the second annular groove 39*b*.

As a function of the position of the control piston 30 relative to the valve housing 22, the pressure medium is led either via the first annular groove 39*a* to the working port B or via the third annular groove 39*c* to the working port A and from there to the corresponding pressure chamber 14, 15. Simultaneously, pressure medium is led from the other pressure chamber 14, 15 to the other working port A, B and from there into the second annular groove 39*b*. Using the second radial opening 34*b*, the pressure medium is led into the central pressure medium duct 40, from where it is led in the axial direction to the discharge port T and thus is discharged from the control valve 20. Here, the walls 42 prevent, in turn, the pressure medium being discharged from reaching into the first or third annular groove 39*a*, 39*c*.

The pressure medium ducts 40, 41 are formed in this embodiment by an insert part 43, which is produced separate to the control piston 30 and which is then arranged in its interior by a non-positive fit, positive fit, friction fit, or material fit connection.

FIGS. 4, 4*a-d* show another construction of a control piston 30 of a control valve 20 according to the invention. In broad parts, this is identical to the control piston 30 shown in FIG. 3. In contrast to the first embodiment, the separation between the pressure medium ducts 40, 41 is realized by walls 42 constructed in one piece with the control piston 30. In this embodiment, in turn, a first central pressure medium duct 40 is constructed, on which, in the radial direction, two opposing second pressure medium ducts 41 contact. The second pressure medium ducts 41, in turn, have a non rotationally symmetric construction with respect to the longitudinal axis 36 of the control piston 30.

The first pressure medium duct 40 communicates, first, with the discharge port T and, second, with the second annular groove 39*b*. The second pressure medium ducts 41 communicate both with the first and also with the third annular groove 39*a*, 39*c*.

FIGS. 5, 5*a*-5*d* show a third embodiment of a control piston 30 of a control valve 20 according to the invention, which is identical in broad parts to the first two embodiments. However, in this embodiment within the control piston 30 there are two first and two second pressure medium ducts 41. The first and the second pressure medium ducts 40, 41 extend, in turn, in the axial direction, but in this embodiment are arranged alternating in the circumferential direction. The walls 42 separating the pressure medium ducts 40, 41 are not constructed, as in the first two embodiments, as chords, but instead run along two inner diameters of the control piston 30 running perpendicular to each other.

The opposing second pressure medium ducts 41 in the representations 5*a*-5*d* in the vertical direction connect, in turn, the first to the third annular groove 39*a*, 39*c*, while the horizontally opposite first pressure medium ducts 40 connect the discharge port T to the second annular groove 39*b*.

In addition to the one-part construction of the control valve 20 with a central screw 17, by which the device 1 is fixed to the camshaft 3*a*, embodiments are similarly conceivable, in which the device 1 is fixed by a non-positive fit, positive fit, or material fit connections to a camshaft 3*a* and the control valve 20 is constructed as a separate component. Also conceivable is the use of a control valve 20 according to the invention as a so-called insert or cartridge valve, which is mounted in a valve receptacle 4*a* in the cylinder head or cylinder head cover, wherein the working ports A, B of the control valve 20 are led by means of suitable pressure medium lines and rotary feedthroughs to the adjuster.

Advantageously, the control piston 30 of the control valve 20 according to the invention or the insert part 43 is produced by an injection molding process. Here, it is conceivable to produce the components from a suitable plastic by a plastic injection molding method or from metal by a powder metallurgical injection molding method, also known as a metal injection molding process.

In both processes, molded bodies are produced, which already have all of the typical geometric features of the component in negative. In these molded bodies, in the case of a plastic injection molding process, the plastified plastic is inserted under pressure. Then the plastic is cured and can be removed from the reusable molding bodies after this processing step.

In the case of a powder metallurgical injection molding process, the molding body is filled during the injection molding process with a mixture of fine metal powder and organic binders. Then the organic binders are removed, for example, through evaporation or solvent extraction, and the remaining blank is compacted through sintering under corresponding protective gases or vacuum to form the final control piston 30.

For the production of non rotationally symmetric components, injection molding processes have the advantage that the shaping of the components can be realized without expensive cutting finishing work, such as, for example, milling or drilling.

In the case of working ports A, B arranged directly adjacent in the axial direction, the non rotationally symmetric construction of the pressure medium ducts 40, 41 shown in the embodiments has the advantage that no additional openings must be formed on the cylindrical casing surface of the valve housing 22 and thus fewer structural features must be realized. This leads to a considerable cost reduction for the production of the control valve 20.

In addition to the shown embodiments or analogous modifications, there is also the possibility of forming one of the pressure medium ducts 40, 41 within the control piston 30 and the other of the pressure medium ducts 40, 41 on the outer casing surface of the control piston 30. In this case, the working ports A, B must be arranged in the circumferential direction at equalizing positions of the valve housing 22. In addition, a rotational lock must be provided between the valve housing 22 and control piston 30.

REFERENCE SYMBOLS

1 Device
1*a* Adjustment device
2 Stator
3 Driven element
3*a* Camshaft
4 Wheel hub
4*a* Valve receptacle
4*b* Central borehole
5 Drive wheel
6 Vane
7 Inner circumferential wall
8 Outer circumferential wall
9 Side wall
10 Pressure space
11 Housing
12 Sealing disk
13 Base
14 First pressure chamber
15 Second pressure chamber
16 Opening
16*a* Weld connection
17 Central screw
18 Receptacle
19 Collar
20 Control valve
21 Receptacle
22 Valve housing
23*a* Opening
23*b* Opening
23*c* Opening
24 Supply port
25*a* First annular channel
25*b* Second annular channel
26 Pressure medium line
27 Supply line
28 Camshaft bearing position
29 Branch bore
30 Control piston
31 Actuating unit
32 Tappet rod
33 Spring element
34*a* First radial opening
34*b* Second radial opening
34*c* Third radial opening
35 Fourth radial opening
36 Longitudinal axis
38*a* Annular space
38*b* Groove
39*a* First annular groove
39*b* Second annular groove
39*c* Third annular groove
40 First pressure medium duct
41 Second pressure medium duct
42 Wall
43 Insert part
100 Internal combustion engine
101 Crankshaft
102 Piston
103 Cylinder
104 Traction mechanism drive
105 Traction mechanism drive
106 Inlet camshaft
107 Outlet camshaft
108 Cam
109 Cam
110 Inlet gas-exchange valve
111 Outlet gas-exchange valve
A Working port
B Working port
P Feed port
T Discharge port

The invention claimed is:

1. A control valve for a device for the variable setting of the control times of gas-exchange valves of an internal combustion engine comprising:

an essentially hollow cylindrical valve housing, and a control piston displaceably arranged in the valve housing in an axial direction, two working ports and two supply ports are formed on the valve housing, each of the working ports is formed by at least one radial opening in an outer casing surface of the valve housing, the working ports are spaced apart from each other in the axial direction, at least two axial pressure medium ducts bounded opposite each other are formed on the control piston, each of the axial pressure medium ducts communicates with one of the supply ports in each position of the control piston, each of the axial pressure medium ducts is connectable to at least one of the working ports through suitable positioning of the control piston relative to the valve housing, and at least one of the axial pressure medium ducts has a non rotationally symmetric construction with respect to a longitudinal axis of the control valve.

2. The control valve according to claim 1, wherein the working ports are arranged directly adjacent one another in the axial direction.

3. The control valve according to claim 1, wherein exactly two of the working ports are formed on the valve housing.

4. The control valve according to claim 1, wherein exactly two of the supply ports are formed on the valve housing.

5. The control valve according to claim 1, wherein one of the supply ports is formed as a feed port, through which pressure medium is fed to the control valve.

6. The control valve according to claim 1, wherein one of the supply ports is constructed as a discharge port, through which the pressure medium can be discharged from the control valve to a tank.

7. The control valve according to claim 1, wherein each of the pressure medium ducts are connectable to each of the working ports through suitable positioning of the control piston relative to the valve housing.

8. The control valve according to claim 1, wherein all of the pressure medium ducts are formed within the control piston.

9. The control valve according to claim 8, wherein a wall separating the pressure medium ducts from each other is formed in one piece with the control piston.

10. The control valve according to claim 8, wherein the control piston is constructed as an essentially hollow, cylindrical component, having an interior in which a separately produced insert component is provided, with the insert component forming the pressure medium ducts in interaction with an inner casing surface of the control piston.

11. The control valve according to claim 1, wherein at least one of the pressure medium ducts is constructed on an outer casing surface of the control piston.

12. The control valve according to claim 1, wherein the control piston is a metallurgical injection molded metal part.

13. The control valve according to claim 1, wherein the control piston is a plastic injection molded part.

14. A control valve for a device for the variable setting of the control times of gas-exchange valves of an internal combustion engine comprising:

an essentially hollow, cylindrical valve housing, and a control piston arranged displaceable in the valve housing in an axial direction, exactly two working ports, exactly one first and exactly one second supply port being constructed on the valve housing, with pressure medium being fed from a pressure medium pump via one of the first and second supply ports to the control valve and the pressure medium being able to be discharged from the control valve into a tank via the other of the first and second supply ports, both of the working ports and the first supply port are formed by at least one radial opening in an outer casing surface of the valve housing, the working ports and the first supply port are arranged spaced apart from each other in the axial direction and the first supply port is arranged in the axial direction between the working ports on one side and a supply line on the other side, the first supply port communicates with the supply line, the working ports are arranged directly adjacent one another in the axial direction, and the first supply port connects to the working ports in the axial direction on a side of the supply line.

15. The control valve according to claim 14, wherein at least two axial pressure medium ducts bounded opposite each other are formed on the control piston, with each of the pressure medium ducts communicating with one of the supply ports in each position of the control piston, with each of the pressure medium ducts being connectable to at least one of the working ports through suitable positioning of the control piston relative to the valve housing and with at least one of the pressure medium ducts having a non rotationally symmetric construction with respect to a longitudinal axis of the control valve.

16. The control valve according to claim 14, wherein the supply line is formed at least in some sections as an annular space between the valve housing and a surrounding construction.

17. The control valve according to claim 14, wherein the supply line is constructed at least in some sections as at least one groove, which is provided on an outer casing surface of the control piston and which opens into the first supply port.

18. A device for the variable setting of the control times of gas-exchange valves of an internal combustion engine comprising a control valve, which is arranged in a valve receptacle of a surrounding construction, with an essentially hollow, cylindrical valve housing, and a control piston displaceably arranged in the valve housing in an axial direction, at least two working ports and at least one first supply port are formed on the valve housing, pressure medium is either fed from a pressure medium pump to the control valve or discharged from the control valve into a tank via the first supply port, the first supply port is formed by at least one radial opening in an outer casing surface of the valve housing, and is arranged in the axial direction between the working ports on one side and a supply line on the other side, with which it communicates, and the supply line is constructed at least in some regions by a groove, which is constructed on an inner casing surface of the valve receptacle of the surrounding construction and which opens into the first supply port.

* * * * *